US006767289B2

(12) United States Patent
Porter

(10) Patent No.: US 6,767,289 B2
(45) Date of Patent: Jul. 27, 2004

(54) GOLF CUP

(76) Inventor: Robert E. Porter, 315 Sculps Rd., Auburn, PA (US) 17922

( * ) Notice: Subject to any disclaimer, the term of this patent is extended or adjusted under 35 U.S.C. 154(b) by 0 days.

(21) Appl. No.: 10/364,097

(22) Filed: Feb. 11, 2003

(65) Prior Publication Data

US 2003/0157989 A1 Aug. 21, 2003

Related U.S. Application Data

(60) Provisional application No. 60/355,606, filed on Feb. 11, 2002.

(51) Int. Cl.[7] ..... A63B 69/36; A63B 57/00

(52) U.S. Cl. ..... 473/175

(58) Field of Search ..... 473/175–179

(56) References Cited

U.S. PATENT DOCUMENTS 1,943,610 A * 1/1934 John ..... 473/176
4,360,200 A * 11/1982 English ..... 473/177
5,382,018 A * 1/1995 Browne ..... 473/409
5,451,045 A * 9/1995 Garske ..... 473/176
6,113,503 A * 9/2000 Brookman ..... 473/176
6,409,608 B1 * 6/2002 Garske ..... 473/175
6,478,687 B1 * 11/2002 Colonello ..... 473/175
2002/0094878 A1 * 7/2002 Porter ..... 473/175

* cited by examiner

*Primary Examiner*—Mark S. Graham
(74) *Attorney, Agent, or Firm*—Fox Rothschild LLP

(57) ABSTRACT

A golf cup assembly is disclosed. The golf cup has a lower cylinder assembly having a cylindrical housing and a transverse member positioned within the interior of the cylindrical housing. A generally cylindrical sleeve depends from and is supported by the transverse member and is adapted to receive and support a flagpole. An upper cylinder has a sidewall adapted to slidably engage the upper portion of the lower cylinder assembly and extends above the upper rim of the lower cylinder housing. The overall assembly has a means for securing the upper cylinder to the lower cylinder assembly. Preferably, the upper cylinder is plastic and the lower cylinder assembly is metal.

17 Claims, 5 Drawing Sheets

GOLF CUP

This patent application claims the priority under 35 U.S.C. §119 of U.S. provisional patent application No. 60/355,606 filed on Feb. 11, 2002 which is hereby incorporated by reference in its entirety.

BACKGROUND OF THE INVENTION

1. Field of the Invention

This invention relates to the golf cup, which is the device that sits within the golf hole. The device serves a number of duties: 1) the golf cup supports the flag pole vertically within the center of the hole to clearly identify the location of the hole to golfers who are a substantial distance from the hole; 2) the golf cup prevents the soil which forms the golf hole from collapsing inwardly; 3) the golf cup is often colored white to make the hole more visible and thus make putting more convenient for golfers who are near the hole; and 4) the golf cup serves as a resting place for balls that are successfully putted into the hole and is often recognized for the tone that it produces when the ball drops into it.

2. Discussion of the Prior Art

Ordinary golf cups contain three common features: 1) an outer cylinder (approximately four and a quarter inches in diameter) that provides visibility to the golfer and prevents the soil surrounding the hole from collapsing inwardly; 2) a flagpole support cylinder that sits coaxially within the lower half of the outer cylinder and provides a snug fit with the flag pole to keep the flagpole vertical; and 3) a tapered bottom feature that sits within the mid-portion of the outer cylinder and connects the outer cylinder to the flagpole support cylinder. The tapered bottom feature supports the golf ball once putted into the hole and guides the pole into the flagpole support cylinder.

The flagpole support cylinder and the bottom piece of the flagpole (commonly referred to as the "ferrule") are exposed to a great deal of "wear and tear". There is a great deal of dirt and sand in the environment in which they exist and the wind on the flag and repeated flagpole removal and replacement create a powerful abrasive force between the two devices. Therefore, golf cups that are constructed out of metal are commonly considered to last much longer due to their greater resistance against this abrasive force.

However, metals are not naturally white and thus must be painted in order to sustain visibility. A chipped, rusty, or mis-colored cup can create a negative impression of a golf course and its greens keeper. For this reason, some greens keepers prefer to use white plastic cups due to their lower cost and natural white finish, which cannot be "chipped" away from the outer cylinder by the flagpole. While plastic cups are less expensive and easier to maintain, metal cups are more traditional, last longer, and produce the cherished "ball-drop" tone that many golfers and greens keepers demand. For these reasons, many greens keepers are forced to switch back and forth between cup styles, depending on what their golfers currently favor. As is the case with both common metal and plastic cups, when a feature becomes worn or defaced, the entire cup must be refinished or discarded.

Typically, there are two sizes of golf cups that a greens keeper must procure and use. One is for practice putting greens and the other is for greens used in regular play. The golf cup used on regular greens is generally several inches deeper that the golf cup used on practice putting greens. The deeper cup is necessary on regular greens, because the golf cup must support the flag and flagpole. In order to provide the required stability to support the flagpole, the golf cup used on regular greens must have a greater exterior surface area than the golf cup used on practice greens.

SUMMARY OF THE INVENTION

It is the object of this invention to provide a golf cup that utilizes numerous parts.

It is the object of this invention is to provide a golf cup that utilizes numerous parts that are replaceable.

Another object of this invention is to provide a golf cup that utilizes numerous parts that are made from different materials, using the material which best suits the part of the cup where it is being used.

Another object of this invention is to provide a golf cup that can be dismantled and assembled using no tools other than the human hand.

Another object of this invention is to create a golf cup that appeals to greens keepers who normally use plastic cups and to greens keepers who normally use metal cups.

Another object of this invention is to create a golf cup that successfully possesses the popular features of both metal and plastic golf cups.

Another object of this invention is to create a golf cup that creates a pleasing tone when the golf ball drops into it.

It is the object of this invention to create a golf cup that lasts a long time while sustaining high visibility without high expense or continual and time consuming maintenance.

These and other objects of the invention are achieved by creating a golf cup that has two separate outer cylinder features, an upper cylinder to provide visibility and a lower cylinder to provide stability. In the preferred embodiment, the lower cylinder, the tapered bottom feature, and the flagpole support cylinder are created out of metal to provide a long lasting cup that produces the favorable ball-drop tone. The upper cylinder is created out of plastic to provide high visibility, low cost, and ease of replacement. The upper cylinder is connected to the lower cylinder via, for example, a snap fit that can be applied and removed without the aid of tools. The fastening technique or means can be designed as described herein, or by numerous other means including, but not limited to, a twist-locking snap fit, a screw or other fastener fit, a glue bond, a friction fit, a press fit, the use of straps, clamps, clips, or ties, a tongue-and-groove mechanism, a cam groove system, a threaded assembly, a latch or the like. The resulting device will provide the durability, strength, tradition, sound, and stability of a metal cup with the visibility, ease of maintenance, and cost-effectiveness of a plastic cup.

BRIEF DESCRIPTION OF THE DRAWINGS

The accompanying drawings, which are incorporated in and form a part of the specification, illustrate the embodiments of the present invention and, together with the description serve to explain the principles of the invention.

DETAILED DESCRIPTION OF THE INVENTION

Figure 1:
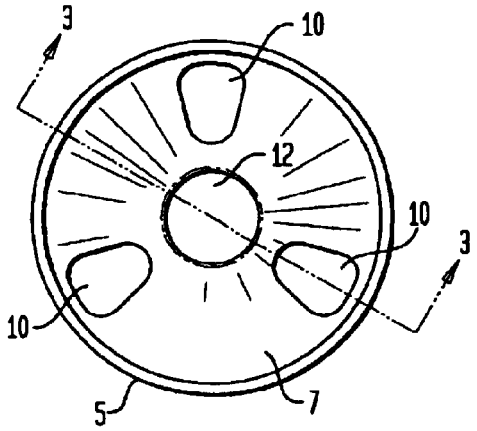
FIG. 1 is a top plan view of the lower cylinder assembly containing the tapered bottom feature and the flagpole support cylinder depending therefrom.

In describing a preferred embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

With reference to the drawings, in general, and FIGS. 1 through 15 in particular, the golf cup apparatus of the present invention is disclosed.

Figure 2:
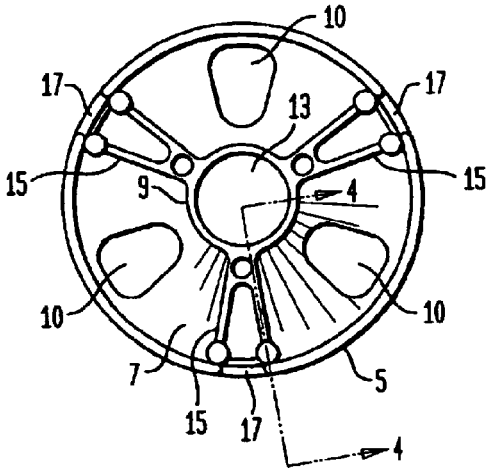
FIG. 2 is a bottom plan view of the lower cylinder assembly containing the tapered bottom feature and the flagpole support cylinder depending therefrom.
Figure 3:
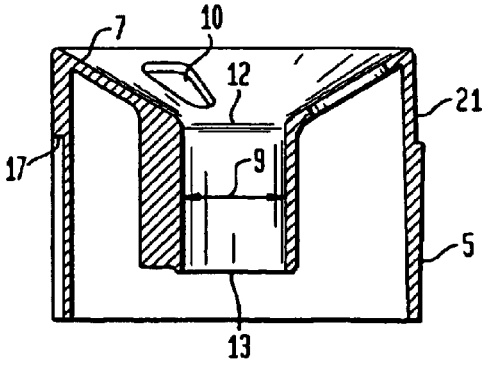
FIG. 3 is a sectional view of the lower cylinder containing the tapered bottom feature and the flagpole support cylinder along line 3—3.
Figure 4:
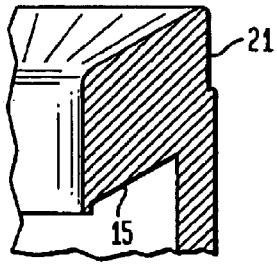
FIG. 4 is a sectional view of the lower cylinder containing the tapered bottom feature and the flag pole support cylinder along line 4—4.

In FIG. 1, there are illustrated three drainage openings 10, flagpole support cylinder's top opening 12, tapered bottom feature 7 of a generally transverse member positioned within the interior the lower cylinder 5. FIG. 2 again shows the three drainage openings 10 and the flagpole support cylinder's bottom opening 13 and the flagpole support cylinder 9 depending from the transverse member. Also shown here are the support beams 15 which serve to add stability to the lower cylinder 5 as well as the bottom side of the tapered bottom feature 7. Collectively, the tapered bottom feature 7 and support beams 15 constitute the transverse member. FIG. 2 also displays the snap gaps 17 which are defined in the lower cylinder 5. The snap gaps 17 allow the snaps 16 (shown in FIG. 8) room to fit into the lower cylinder 5. FIG. 3 shows a sectional view of the lower cylinder 5 with the tapered bottom feature 7 and the flagpole support cylinder 9. This view makes evident the upper cylinder seat 21 which is defined in the upper portion of the lower cylinder 5. FIG. 4 again shows the upper cylinder seat 21 and a sectional view of a support beam 15.

Figure 5:
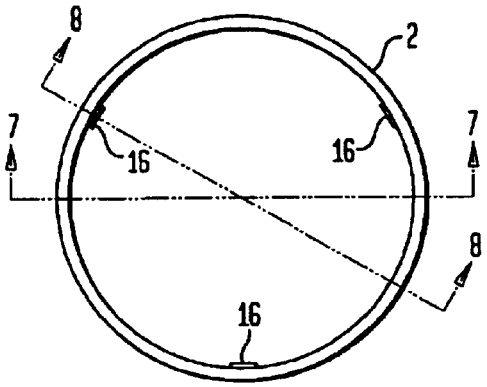
FIG. 5 is a top plan view of the upper cylinder.
Figure 6:
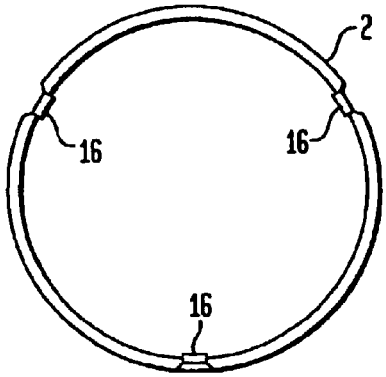
FIG. 6 is a bottom plan view of the upper cylinder.
Figure 7:
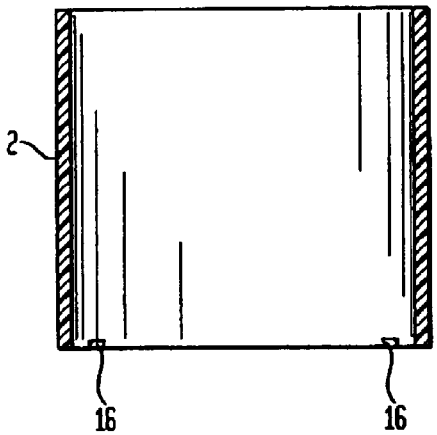
FIG. 7 is a sectional view of the upper cylinder along line 7—7.
Figure 8:
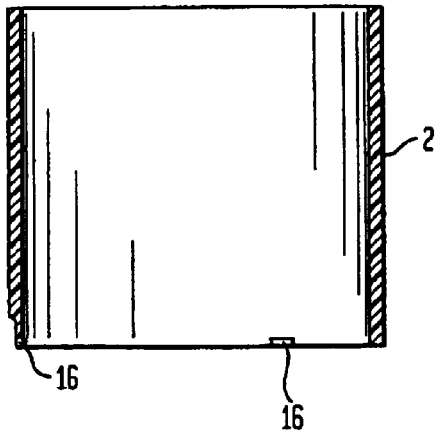
FIG. 8 is a sectional view of the upper cylinder along line 8—8.
Figure 9:
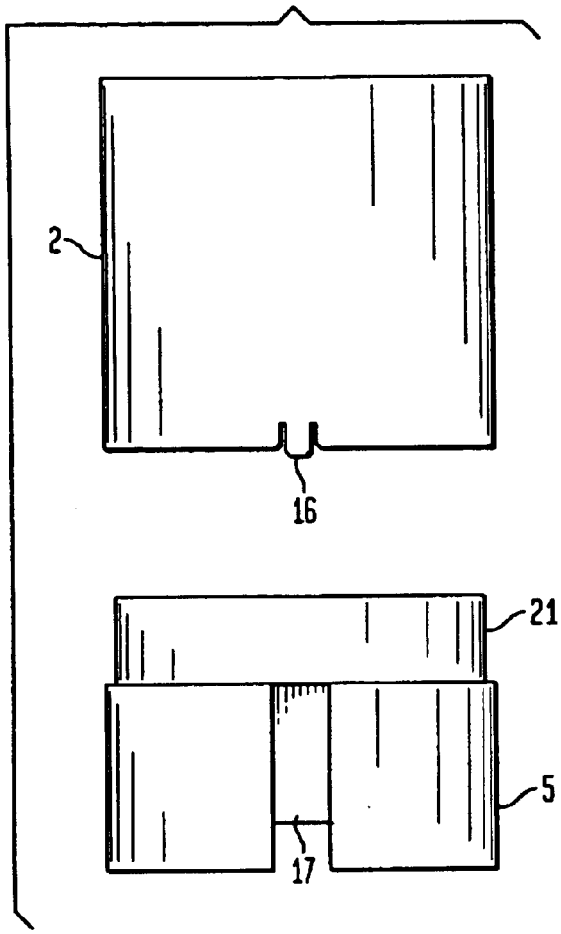
FIG. 9 is an exploded side elevation view of the final assembly.
Figure 10:
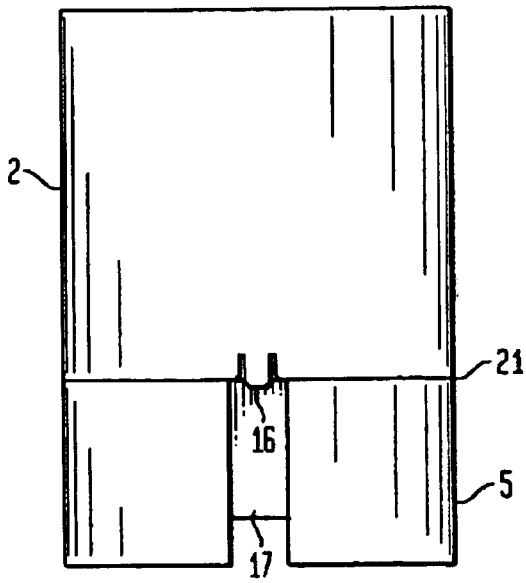
FIG. 10 is a side elevation view of the final assembly of a golf cup according to the present invention.

FIG. 5 shows a top plan view of the upper cylinder 2 and the snaps 16 which are located 120 degrees apart from one another. FIG. 9 shows an exploded assembly view of the upper cylinder 2 having a snap 16 aligned with a snap gap 17 and the upper cylinder 2 aligned with the upper cylinder seat 21. FIG. 10 shows the upper cylinder 2 connected to the lower cylinder 5 by means of a snap 16 engaged with a snap gap 17 with the upper cylinder 2 engaged with the upper cylinder seat 21.

Figure 11:
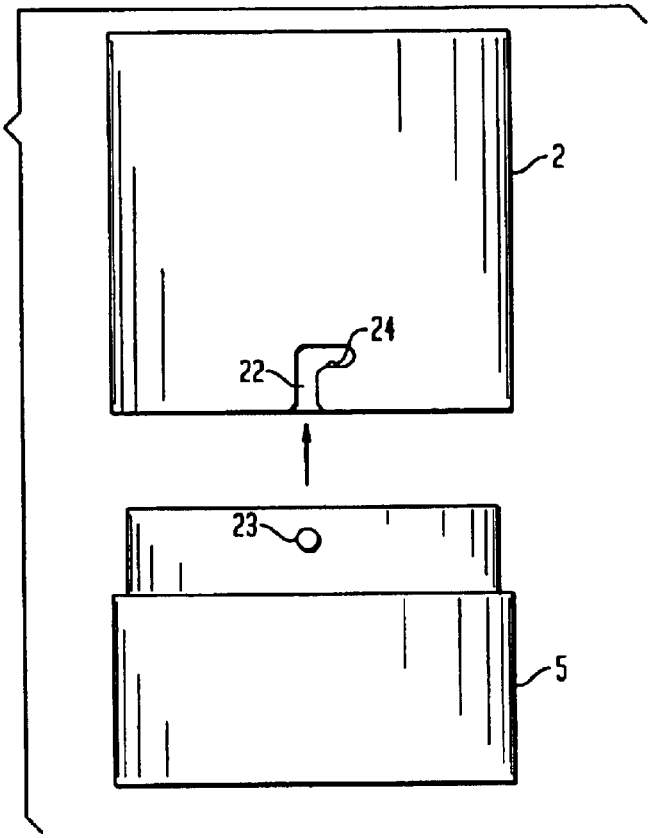
FIG. 11–FIG. 13 illustrate an alternate, twist-locking method of fastening the upper cylinder to the lower cylinder assembly.
Figure 12:
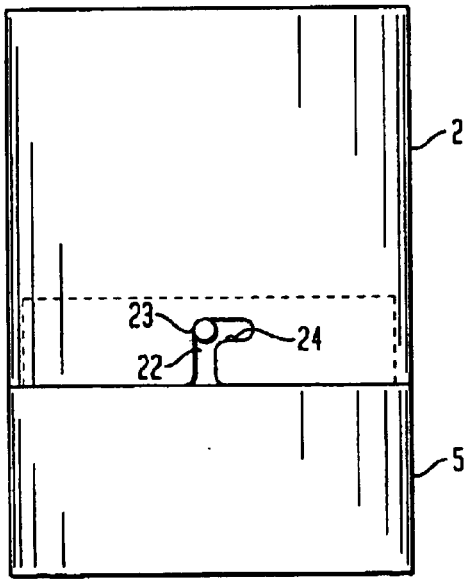
Figure 13:
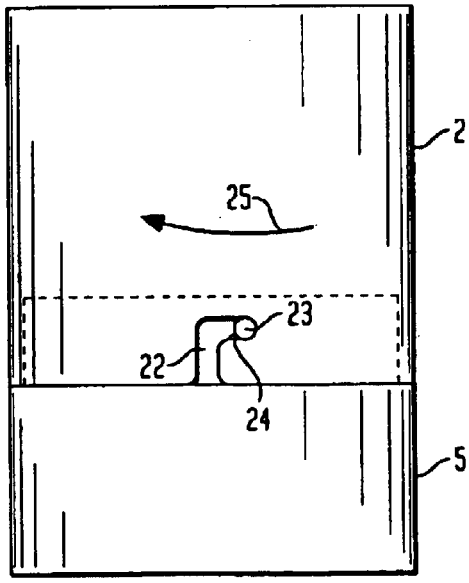

FIG. 11 shows the first step of an alternate fastening method using a twist-locking technique with a slot 22 in the upper cylinder 2 and a knob 23 on the lower cylinder 5. Also displayed is a snap 24 in the horizontal portion of the slot 22. In FIG. 12, the knob 23 is engaged with the vertical portion of the slot 22. FIG. 13 shows the snap 24 securing the knob 23 in the slot 22 by means of a twisting action 25.

Figure 14:
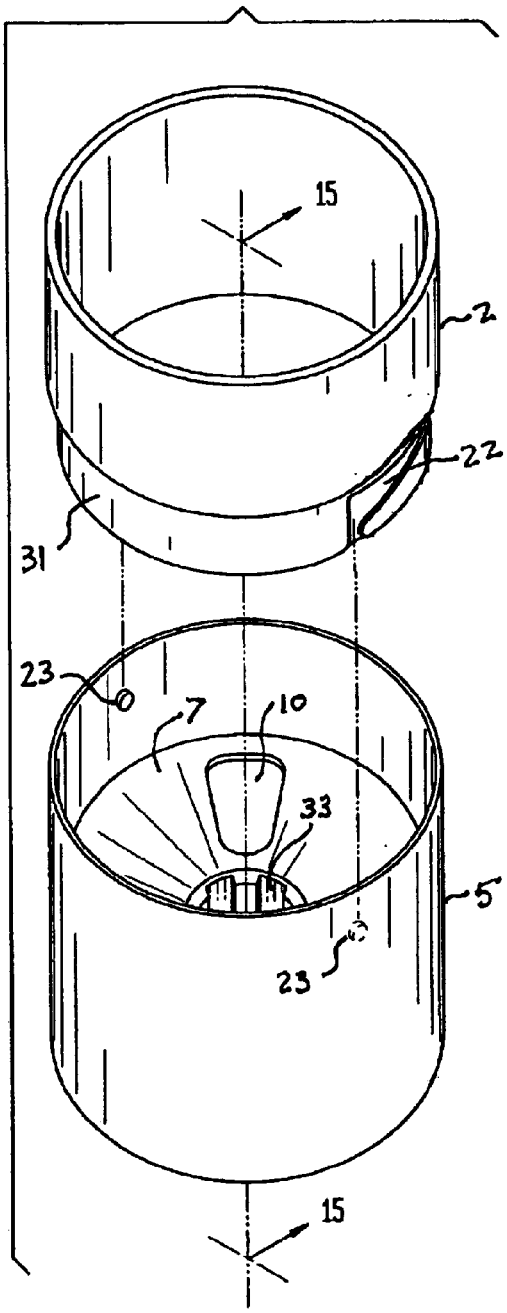
FIG. 14 is an exploded perspective view of an alternative embodiment wherein the lower portion of the upper cylinder is positioned along the interior wall of the upper portion of the lower cylinder assembly.
Figure 15:
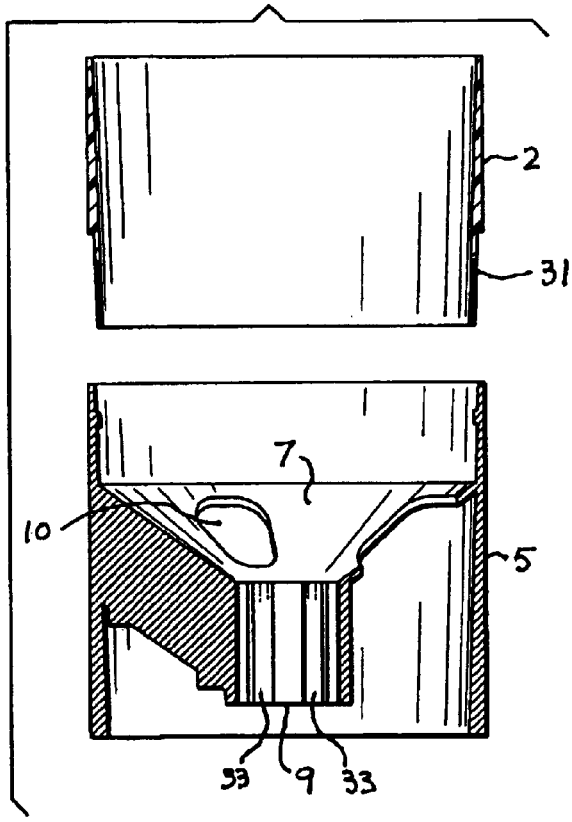
FIG. 15 is a cross-sectional view of the embodiment shown in FIG. 14 through the central axis of the assembly along line 15—15.

FIGS. 14 and 15 illustrate an alternative embodiment of the golf cup according to the present invention. In this embodiment, upper cylinder 2 is seated along the upper portion of the interior sidewall of lower cylinder 5. Preferably, upper cylinder seat 31 extends into lower cylinder 5 to the top of tapered bottom feature 7 thereby forming a substantial portion or substantially all of the visible interior sidewall of the golf cup. Inwardly protruding knobs 23 are slidably engaged within slots 22 to secure the upper plastic cylinder 2 to lower cylinder 5. Flagpole support cylinder 9 has longitudinal drainage grooves 33 along the interior of the cylinder sleeve to facilitate drainage of water from within the golf cup. Drainage grooves 33 permit water that would ordinarily accumulated near the bottom of the flagpole. This drainage feature helps prevent rotting of a wooden ferrule.

Lower cylinder 5 is preferably sized so that it can be used separately as a practice putting green golf cup or, in conjunction with upper cylinder 2, as regular green golf cup. Existing practice putting green golf cups can be fitted with a plastic upper cylinder 2 to provide the golf cup assembly according to the present invention. In this embodiment, the upper cylinder 2 may be secured to lower cylinder 5 by, for example, a friction fit, a clip or the like. The lower portion of upper cylinder 2 is preferably seated within the interior wall of the upper portion of the practice putting green cup.

What is claimed is:

1. A golf cup assembly comprising:

a lower cylinder assembly having a cylindrical housing and a transverse member positioned within the interior of said cylindrical housing for supporting a generally cylindrical sleeve depending from the transverse member and adapted for receiving and supporting a flagpole;

an upper cylinder having a sidewall adapted to slidably engage the upper portion of the lower cylinder housing and extending above the upper rim of the lower cylinder housing; and a means for securing the upper cylinder to the lower cylinder assembly;

wherein the lower cylinder assembly is sized for use as a practice putting green golf cup and, when engaged with the upper cylinder, the resulting golf cup assembly is sized for use as a regular green golf cup.

2. A golf cup assembly according to claim 1 wherein the lower cylinder assembly is made from a metal.

3. A golf cup assembly according to claim 1 wherein the upper cylinder is made from a plastic.

4. A golf cup assembly according to claim 1 wherein the lower portion of the upper cylinder is seated against the exterior of the upper portion of the cylinder sidewall of the lower cylindrical assembly.

5. A golf cup assembly according to claim 1 wherein the lower portion of the upper cylinder is seated against the interior of the upper portion of the cylinder sidewall of the lower cylindrical assembly.

6. A golf cup assembly according to claim 1 wherein the generally cylindrical sleeve comprises a longitudinal drainage groove.

7. A golf cup assembly according to claim 1 wherein the fastening means comprise a knob positioned on the sidewall of the upper portion of the lower cylinder assembly and a slot along the lower portion of the upper cylinder for slidably engaging the knob on the upper cylinder.

8. A golf cup assembly according to claim 5 wherein the sidewall of the upper cylinder is positioned along the interior of the upper portion of the lower cylindrical housing extends to the transverse member.

9. A method for making a golf cup comprising:

providing a lower cylinder assembly having a cylindrical housing and a transverse member positioned within the interior of said cylindrical housing for supporting a generally cylindrical sleeve adapted for receiving and supporting a flagpole wherein the lower cylinder assembly is sized to be used as a practice putting green golf cup; and securing an upper cylinder having a sidewall to the upper portion of the lower cylinder assembly wherein the sidewall is slidably engaged to the cylindrical housing and extends above the rim of the lower cylindrical assembly thereby forming a golf cup sized to be used as a regular green golf cup.

10. A method according to claim 9 wherein the lower cylinder assembly is made from a metal.

11. A method according to claim 9 wherein the upper cylinder is made from a plastic.

12. A golf cup comprising:

a lower cylindrical housing having a flagpole support member dimensioned for holding a flagpole and supported by a transverse member attached to the interior sidewall of the housing;

an upper cylinder member having a sidewall, the lower portion of which is dimensioned to fit within the upper portion of the lower cylindrical housing and to extend above the upper rim of the cylindrical housing thereby forming an interior sidewall of the golf cup;

wherein the lower cylindrical housing is sized for use as a practice putting green golf cup and, when combined with the upper cylinder member, the resulting golf cup is sized for use as a regular green golf cup.

13. A golf cup according to claim 12 wherein the golf cup further comprises a means for securing the upper cylinder member to the lower cylinder housing.

14. A golf cup according to claim 12 wherein the lower cylinder housing is made from a metal.

15. A golf cup according to claim 12 wherein the upper cylinder member is made from a plastic.

16. A golf cup according to claim 12 wherein the transverse member is made from a metal.

17. A golf cup according to claim 12 wherein the flagpole support member comprises a drainage groove along an interior wall of the member.

* * * * *